US006695361B1

(12) United States Patent
Gleason et al.

(10) Patent No.: US 6,695,361 B1
(45) Date of Patent: Feb. 24, 2004

(54) LATCH STRUCTURE

(75) Inventors: Stephen J. Gleason, Charles City, IA (US); Christopher J. Lane, Nashua, IA (US); David Alcantara, New Hampton, IA (US)

(73) Assignee: Tri/Mark Corporation, New Hampton, IA (US)

( * ) Notice: Subject to any disclaimer, the term of this patent is extended or adjusted under 35 U.S.C. 154(b) by 0 days.

(21) Appl. No.: 09/822,896

(22) Filed: Mar. 30, 2001

(51) Int. Cl.[7] ..... E05C 3/06

(52) U.S. Cl. ..... 292/216; 292/201; 292/DIG. 23; 292/DIG. 53; 292/DIG. 58

(58) Field of Search ..... 292/DIG. 58, DIG. 57, 292/216, 201, DIG. 23, DIG. 43, DIG. 53; 70/416, 262, 263, 264, 275, 466, 451, 447, 448

(56) References Cited

U.S. PATENT DOCUMENTS

| | | | | | |
|---|---|---|---|---|---|
| 4,049,305 | A | | 9/1977 | Zetterlund et al. | 292/336.3 |
| 4,131,002 | A | | 12/1978 | Gianelo | 70/84 |
| 4,268,077 | A | | 5/1981 | Bohleen et al. | 292/336.3 |
| 4,420,954 | A | | 12/1983 | Hieronymi et al. | 70/150 |
| 4,438,964 | A | | 3/1984 | Peters | 292/216 |
| 4,494,783 | A | | 1/1985 | Poe | 292/155 |
| 4,588,219 | A | | 5/1986 | Kobayashi et al. | 292/336.3 |
| 4,703,963 | A | | 11/1987 | Ball | 292/336.3 |
| 4,743,052 | A | | 5/1988 | Stammreich et al. | 292/113 |
| 4,756,563 | A | * | 7/1988 | Garwood et al. | 292/216 |
| D303,618 | S | | 9/1989 | Russell et al. | D8/306 |
| 4,882,919 | A | | 11/1989 | Craig | 70/208 |
| 4,889,373 | A | | 12/1989 | Ward et al. | 292/336.3 |
| 5,174,619 | A | | 12/1992 | Bender et al. | 292/336.3 |
| 5,248,175 | A | | 9/1993 | Burns | 292/347 |
| 5,265,450 | A | | 11/1993 | Doyle | 70/118 |
| 5,295,374 | A | | 3/1994 | Bender et al. | 70/208 |
| 5,328,219 | A | * | 7/1994 | Konchan et al. | 204/485 |
| 5,355,554 | A | | 10/1994 | Magoon | 16/124 |
| 5,570,915 | A | | 11/1996 | Asadurian | 292/242 |
| 5,611,224 | A | | 3/1997 | Weinerman et al. | 70/208 |
| 5,636,880 | A | | 6/1997 | Miller et al. | 292/144 |
| 5,678,869 | A | | 10/1997 | Yoshikuwa | |
| 5,689,980 | A | | 11/1997 | Weinerman et al. | 70/208 |
| 5,746,457 | A | | 5/1998 | Kim | |
| 5,746,458 | A | | 5/1998 | Fisher | 292/252 |
| 5,820,174 | A | | 10/1998 | Parikh et al. | 292/126 |
| 5,855,130 | A | * | 1/1999 | Rorabacher et al. | 292/201 |
| 5,875,948 | A | | 3/1999 | Sadler | 224/404 |
| 5,941,104 | A | | 8/1999 | Sadler | 70/208 |
| 5,983,682 | A | * | 11/1999 | Parikh | 292/DIG. 31 |
| 6,053,543 | A | * | 4/2000 | Arabia et al. | 292/201 |
| 6,280,592 | B1 | * | 8/2001 | Mastrofrancesco et al. | 292/201 |
| 6,463,773 | B1 | * | 10/2002 | Dimig | 70/277 |

FOREIGN PATENT DOCUMENTS

| | | |
|---|---|---|
| DE | 41 00 524 A 1 | 7/1991 |
| EP | 0 331 832 | 9/1989 |
| EP | 1 039 079 A1 | 9/2000 |
| GB | 2 325 002 | 6/2000 |

* cited by examiner

*Primary Examiner*—J. J. Swann
*Assistant Examiner*—Dinesh N Melwani
(74) *Attorney, Agent, or Firm*—McKee, Voorhees & Sease, P.L.C.

(57) ABSTRACT

The latch assembly of the present invention is adapted for use on motor vehicles, such as agricultural and construction vehicles, recreation vehicles, utility and emergency vehicles, and heavy-duty trucks. The latch assembly includes a housing with a rotor and catch rotatably mounted therein for movement between open and closed positions for releasing and retaining a striker bolt on the door. Holes in the housing allow the housing to be mounted either internally or externally to the door frame. The rotor and catch are impregnated with a lubricant to minimize friction and extend the life of the latch assembly. A grease block is also provided within the housing to inhibit entry of contaminants, such as dirt, water, and the like, so as to further extend the life of the latch assembly.

10 Claims, 3 Drawing Sheets

LATCH STRUCTURE

BACKGROUND OF THE INVENTION

The present invention generally relates to a latch assembly for motor vehicles, particularly large trucks, recreational vehicles, utility and emergency vehicles, buses and heavy-duty equipment, such as construction vehicles and agricultural vehicles. Latches typically have a rotor and catch pivotally mounted in a housing so as to move between lock and unlocked positions to retain and release, respectfully, a striker bolt on the door. Conventional latches are designed for either an internal or an external mounting on the door frame. However, a universal latch, which can be mounted either internally or externally, has not been available.

The latch must be lubricated to reduce frictional wear on the moving components, particularly the rotor and the catch. Absent proper lubrication, the rotor and/or catch are subject to a reduced life expectancy. For example, the rotor and catch typically are coated with a lubricant but such lubricant eventually wears away or becomes contaminated with foreign particles, such as dirt, which hastens wear on the rotor and catch.

Accordingly, a primary objective of the present invention is an improved latch assembly for motor vehicles.

Another objective of the present invention is the provision of a latch assembly which can be mounted with internally and externally upon a door frame.

Another objective of the present invention is the provision of an approved latch assembly wherein the rotor and catch are impregnated with a lubricant to minimize friction.

A further objective of the present invention is the provision of a motor vehicle latch having an improved grease block to minimize entry of the contaminants into the latch.

Another objective of the present invention is the provision of an improved latch assembly which is economical to manufacture and durable in use.

These and other objectives will become apparent from the following description of the invention.

SUMMARY OF THE INVENTION

The latch assembly of the present invention includes a housing with a rotor and a catch rotatably mounted in the housing. The rotor and catch are pivotal between a locked position to retain a striker bolt on the vehicle frame surrounding the door and an open position to release the striker bolt. The housing includes a plurality of apertures to permit both internal and external mounting of the latch assembly to a door frame. The rotor and catch are impregnated with a lubricant to reduce wear on the latch assembly. A grease block resides within the housing and over the rotor and catch so as to minimize exposure of the rotor and catch to contaminants, and so as to preserve a lubricant coating provided on the rotor and catch.

DETAILED DESCRIPTION OF THE DRAWINGS

Figure 1:
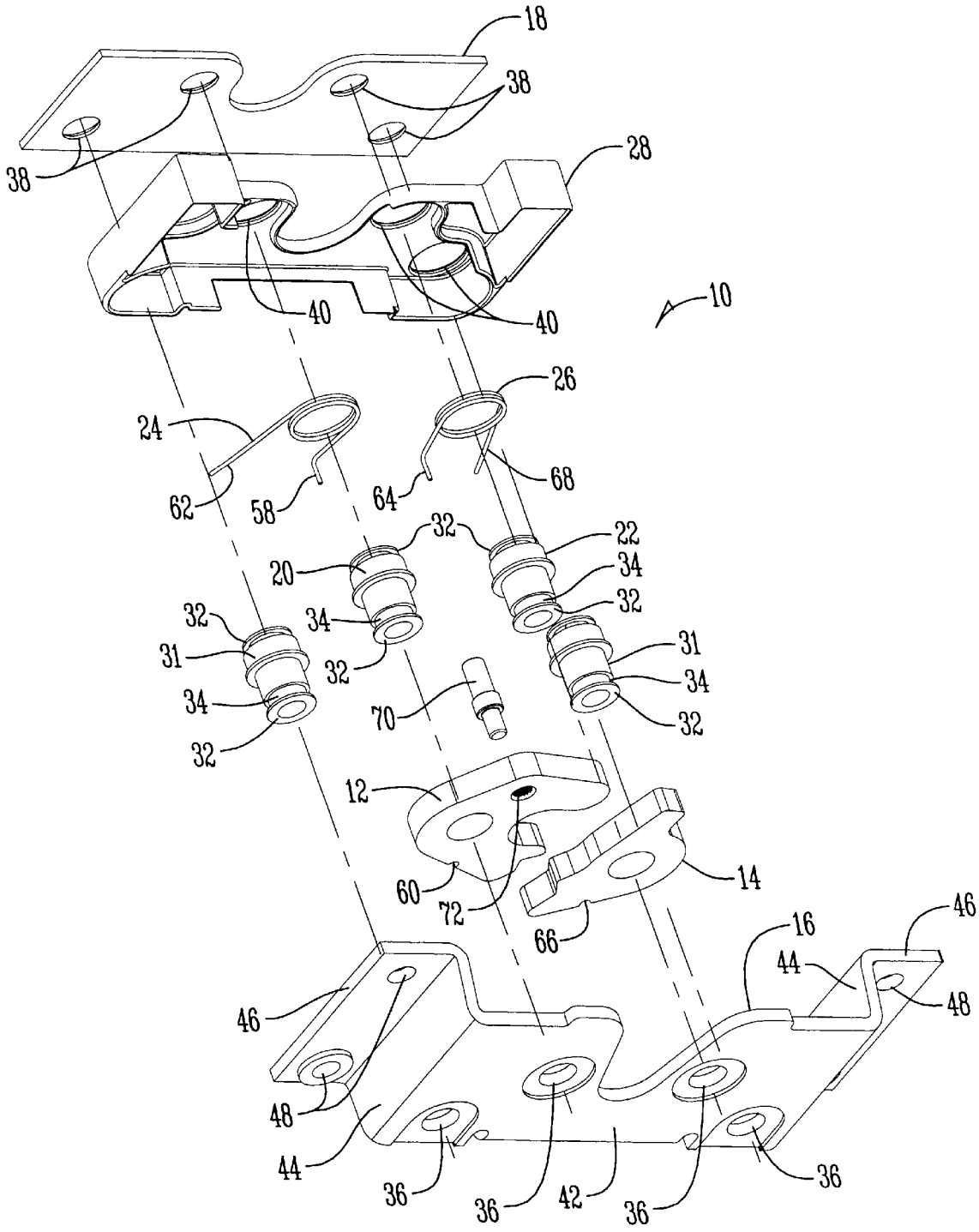
FIG. 1 is an exploded perspective view of the latch assembly of the present invention.

The latch assembly of the present invention is generally designated by the reference numeral 10 in the drawings. The latch assembly 10 includes a rotor 12 and a catch 14 pivotally mounted in a housing defined by a pair of housing plates 16, 18.

More particularly, the rotor 12 is mounted on an axle bearing 20 and the catch 14 is mounted on an axle bearing 22. A rotor spring 24 is mounted on one end of the axle 20, and a catch spring 26 is mounted on one end of the catch axle 22.

Preferably, the rotor 12 and catch 14 are impregnated with a lubricant, such as Gulf Lube, which is a thixotropic lubricant combined with selected thickeners, oxidation and corrosion inhibitors, and other additives. The Gulf Lube product is water-resistant and has low torque and low shear characteristics. The rotor 12 and catch 14 are also coated with the lubricant, such as grease. A grease housing or block 28 is provided between the housing plates 16, 18 to retain the grease within the housing, and to inhibit the entry of contaminants, such as moisture, dirt, and other particles, from the rotor 12 and catch 14.

The housing plates 16, 18 are secured together by the axles 22, 24, and similar bearings 30, 31. The axles 20, 22 and bearings 30, 31 each include an enlarged flange 32 at the opposite ends, and a reduced diameter portion 34 adjacent the flanges 32. The housing plates 16, 18 include a plurality of apertures 36, 38, respectively. The grease block 28 also has a plurality of holes 40. The axles 20, 22 and bearings 30, 31 extend through the aligned holes 36, 38 and 40 in the housing plates 16, 18 and the grease block 28. The diameter of the reduced diameter portion 34 is slightly smaller than the diameter of the holes 36, 38 in the housing plates 16, 18. In assembling the housing plates 16, 18, the axles 20, 22 are mechanically staked or wedged to secure the plates 16, 18 together.

Figure 4:
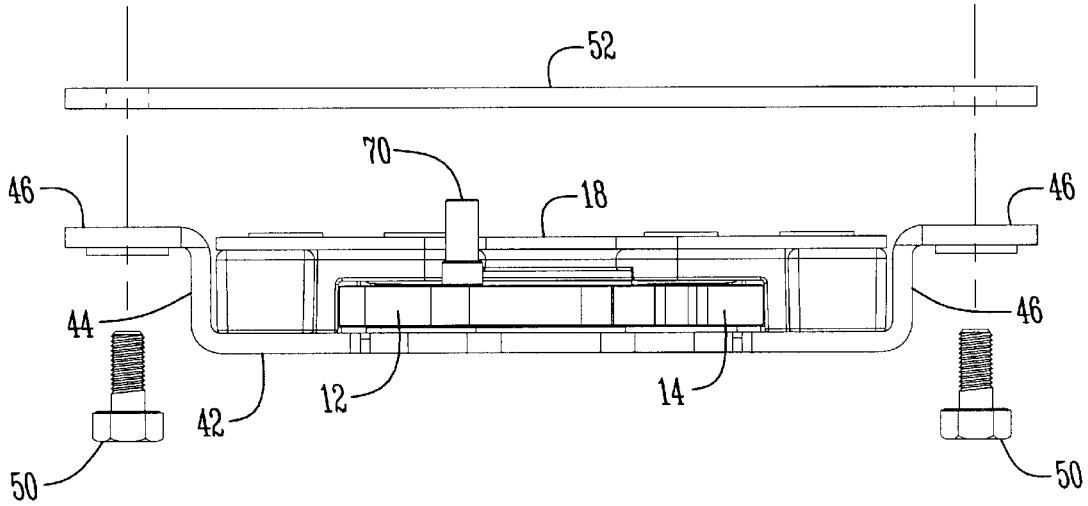
FIG. 4 is a partially exploded side elevation view of the latch assembly showing an external mounting.

The housing plate 16 includes a main body 42, a pair of up-turned legs 44, and a pair of out-turned arms 46. The arms 46 include holes 48 adapted to receive a bolt or screw 50 to externally mount the latch assembly 10 to a door frame 52, as shown in FIG. 4.

Figure 5:
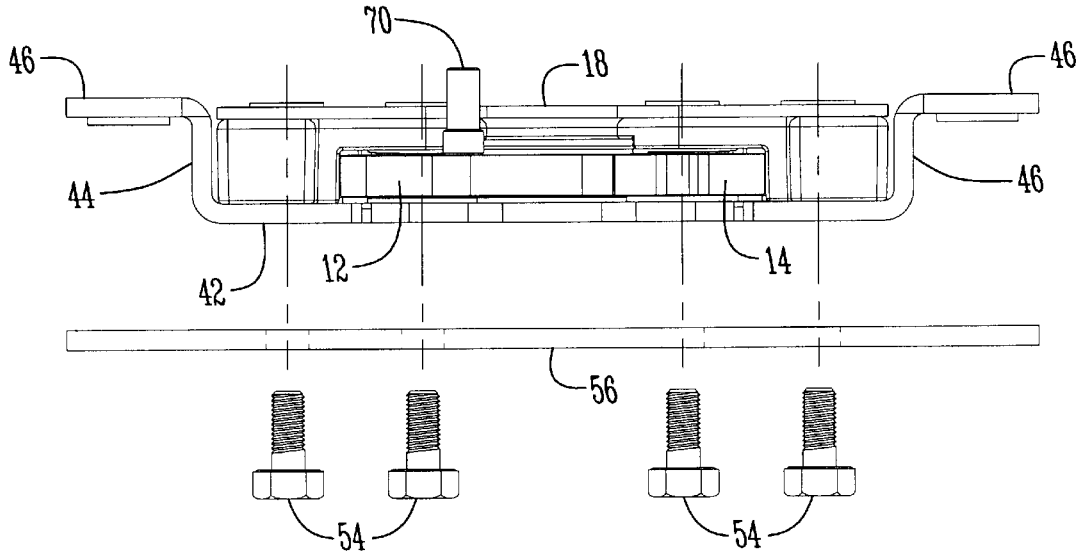
FIG. 5 is a partially exploded side elevation view of the latch assembly showing an internal mounting.

At least some of the axles 20, 22 and bearings 30, 31 are internally threaded so as to be adapted to receive a bolt or screw 54 so that the latch assembly can be internally mounted to a door frame 56, as shown in FIG. 5.

Figure 2:
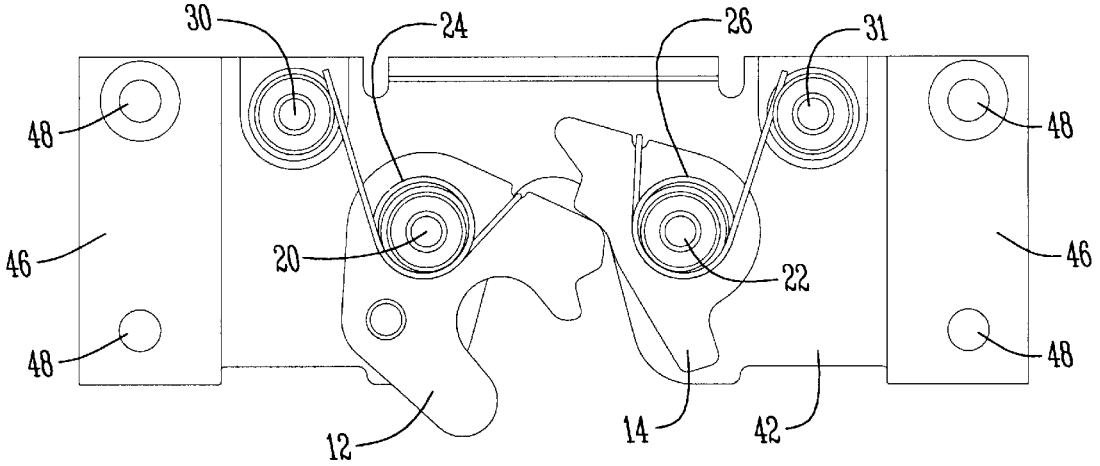
FIG. 2 is a top plan view of the assembled latch, with the grease block and top housing plate removed for clarity.
Figure 3:
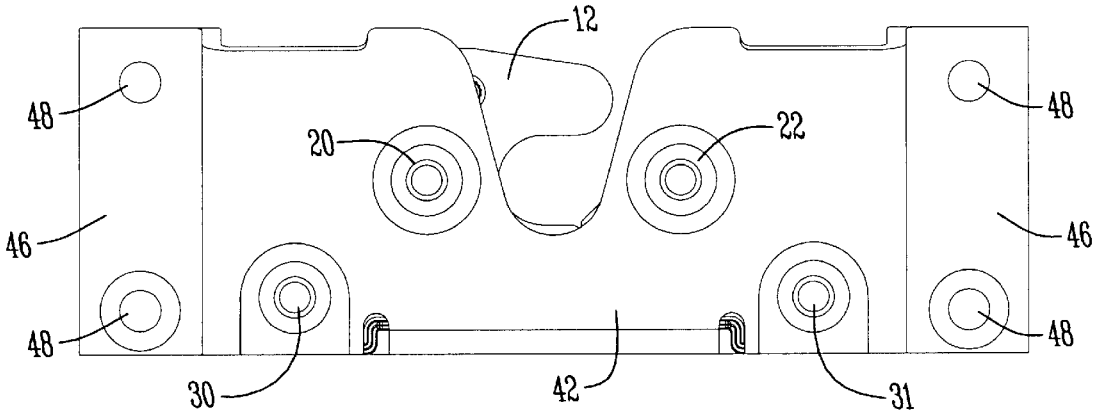
FIG. 3 is a bottom plan view of the assembled latch.

The rotor spring 24 lies around the rotor axle 20, and includes a leg 58 captured in a groove 60 in the rotor 12. The rotor spring 24 includes an opposite leg 62 which engages the upper left-hand bearing 30, as seen in FIG. 2. The rotor spring 24 functions to eject the rotor 12 to the open position when released from the catch 14. The catch spring 26 includes a leg 64 received in a groove 66 in the catch 14, and an opposite leg 68 engaging the upper right hand bearing 31, as seen in FIG. 2. The catch spring 26 functions to return the catch 16 to the locked position.

The overall thickness of the latch assembly 10 allows the assembly to have a great amount of door clearance when externally mounted. The latch assembly 10 allows for door racking in the positive Y direction, thereby assisting a reduction of door aperture and hinge stress.

Preferably, the housing plates 16, 18 are made of steel, with a zinc yellow chromate finish to provide corrosion resistance. The rotor 12 and catch 14 are preferably manufactured from high density powdered metal material, with a zinc yellow chromate coating finish, so as to provide maximum strength versus weight, reduced co-efficient of friction, increased resistance to wear, and increased resistance to corrosion. The axles 22, 24 are preferably manufactured from a high strength, machinable steel, with a zinc yellow chromate finish. The grease block 28 is preferably manufactured from engineered plastic, since it is a non-load-bearing component. The springs 24, 26 are preferably manufactured from stainless steel spring wire to provide resistance to corrosion.

The latch assembly 10 includes a rotor pin 70 which is pressed into a hole 72, and serves as an interface component with a logic assembly (not shown). The pin 70 functions with structure in the logic assembly to preclude locking of the door when the rotor 12 and catch 14 are in the open position.

The latch of the present invention meets all Federal Motor Vehicle Safety Standards for transverse and longitudinal loads.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A latch assembly for motor vehicles having a personnel door for entry into and exit from a vehicle by a person, the door having a perimeter frame, comprising:

a housing;

a rotor rotatably mounted in the housing;

a catch rotatably mounted in the housing;

the rotor and catch being pivotal between a locked position to retain a striker bolt on the door and an open position to release the striker bolt;

the housing including a first set of apertures for mounting the assembly internally to the door frame;

the housing including a second set of apertures for mounting the assembly externally to the door frame; and the apertures of the first and second sets being axially offset from one another; with the first set of apertures located in between the second set of apertures.

2. The latch of claim 1 wherein the assembly includes a first plurality of internally threaded apertures for mounting the assembly internally to the door frame.

3. The latch of claim 1 further including a rotor axle and catch axle mounted in the housing and upon the rotor and catch are mounted, respectively.

4. The latch of claim 3 wherein the axles are hollow with internal threads defining the first apertures for mounting the assembly internally to the door frame.

5. The latch of claim 1 wherein the housing includes first and second plates secured together.

6. The latch of claim 5 wherein the housing plates are staked together by a plurality of axles.

7. The latch of claim 5 wherein the first set of apertures extend through the first and second plates for mounting the assembly internally to the door frame.

8. The latch of claim 5 wherein the first plate has opposite side flanges, with the second apertures being in the flanges for mounting the assembly externally to the door frame.

9. The latch of claim 1 wherein the rotor and catch are impregnated with a lubricant.

10. The latch of claim 1 wherein the housing includes a grease block to retain grease applied to the rotor and catch.

* * * * *